US007100363B2

(12) United States Patent
Odendall

(10) Patent No.: US 7,100,363 B2
(45) Date of Patent: Sep. 5, 2006

(54) METHOD FOR OPERATING AN INTERNAL COMBUSTION ENGINE OF A VEHICLE, IN PARTICULAR A MOTOR VEHICLE

(75) Inventor: Bodo Odendall, Neuburg (DE)

(73) Assignee: Audi AG, (DE)

( * ) Notice: Subject to any disclaimer, the term of this patent is extended or adjusted under 35 U.S.C. 154(b) by 0 days.

(21) Appl. No.: 10/534,980

(22) PCT Filed: Oct. 31, 2003

(86) PCT No.: PCT/EP03/12112

§ 371 (c)(1),
(2), (4) Date: Nov. 2, 2005

(87) PCT Pub. No.: WO2004/046529

PCT Pub. Date: Jun. 3, 2004

(65) Prior Publication Data

US 2006/0162319 A1 Jul. 27, 2006

(30) Foreign Application Priority Data

Nov. 15, 2002 (DE) ..... 102 53 614

(51) Int. Cl.
*F01N 3/00* (2006.01)

(52) U.S. Cl. ..... 60/285; 60/274; 60/276; 60/297

(58) Field of Classification Search ..... 60/274, 60/276, 285, 295, 297, 301
See application file for complete search history.

(56) References Cited

U.S. PATENT DOCUMENTS

| | | | | |
|---|---|---|---|---|
| 5,983,629 | A * | 11/1999 | Sawada | 60/276 |
| 6,502,388 | B1 * | 1/2003 | Takaku et al. | 60/285 |
| 6,708,668 | B1 * | 3/2004 | Yoshida et al. | 123/295 |
| 6,778,898 | B1 * | 8/2004 | Bidner et al. | 701/109 |
| 6,826,902 | B1 * | 12/2004 | Sun et al. | 60/274 |

FOREIGN PATENT DOCUMENTS

| | | |
|---|---|---|
| DE | 19753718 | 7/1999 |
| DE | 10064279 | 11/2001 |
| EP | 0585900 | 3/1994 |
| EP | 1134392 | 9/2001 |

* cited by examiner

*Primary Examiner*—Binh Q. Tran
(74) *Attorney, Agent, or Firm*—Stevens, Davis, Miller & Mosher, LLP

(57) ABSTRACT

The invention relates to a method for operating an internal combustion engine of a vehicle, in particular a motor vehicle, with a first operating range as the lean operating range, to discharge the nitrogen oxide storage catalyst by means of an engine control device switching from the lean operating range to the rich operating range taking place. As claimed in the invention, the engine control device blocks switching into the lean operating range if the additional amount of fuel consumption for discharges in a certain, definable evaluation interval which extends over several lean operating phases is greater than or equal to the reduced amount of fuel consumption by lean operation in this monitoring interval. Furthermore, the engine control device enables lean operation and thus switching between the lean operating range and the homogeneous operating range if the additional amount of fuel consumption for discharges in the evaluation interval is smaller than the reduced amount of fuel consumption by lean operation in this evaluation interval. The reduced amount of fuel consumption is determined as a function of the raw mass flow value of the nitrogen oxide averaged over the evaluation interval, as a function of the amount of fuel saved which has been averaged over the evaluation time interval in the lean operating phases which occur in the evaluation interval compared to the homogeneous operating range phases in this evaluation interval, and as a function of the time between two torque requirements which exceed a definable load boundary value and/or rpm boundary value and which cause departure from the lean operating range, which time has been averaged over the evaluation interval, while the additional amount of fuel consumption is determined as a function of a storage catalyst charging state averaged over the evaluation interval.

12 Claims, 1 Drawing Sheet

METHOD FOR OPERATING AN INTERNAL COMBUSTION ENGINE OF A VEHICLE, IN PARTICULAR A MOTOR VEHICLE

This application is a § 371 application of PCT/EP03/012112, which claims priority from DE 10253614.7, filed Nov. 15, 2002.

BACKGROUND

The invention relates to a method for operating an internal combustion engine of a vehicle, in particular a motor vehicle.

In current automotive engineering, spark ignition engines as internal combustion engines with direct gasoline injection are preferred over conventional manifold injection, since these internal combustion engines compared to conventional spark ignition engines have distinctly more dynamics, are superior with respect to torque and output, and at the same time enable a reduction in fuel consumption by up to 15%. This is made possible by so-called stratification in the partial load range, in which an ignitable mixture is required only in the area of the spark plug, while the remaining combustion chamber is filled with air. Since conventional internal combustion engines which operate according to the manifold principle can no longer be ignited at such a high air excess as is present in direct gasoline injection, in this stratification mode the fuel mixture is concentrated around the spark plug which is positioned centrally in the combustion chamber, while pure air is present in the edge areas of the combustion chamber. In order to be able to center the fuel mixture around the central spark plug positioned in the combustion chamber, a dedicated air flow in the combustion chamber is necessary, a so-called tumble flow. An intensive, roller-shaped flow is formed for that purpose and fuel is injected only in the last third of the upward motion of the piston. The combination of the special air flow and the dedicated geometry of the piston which has for example a pronounced fuel flow depression, concentrates the especially finely atomized fuel in a so-called "mixture ball" optimally around the spark plug and reliably ignites it. The engine control or engine control device provides for the respectively optimum adjustment of injection parameters (injection instant, fuel pressure).

These internal combustion engines can therefore be operated for a correspondingly long time in lean operation; this overall has a beneficial effect on fuel consumption, as has already been described in the foregoing. This lean operation however entails the disadvantage of a much greater amount of nitrogen oxide in the exhaust gas so that the nitrogen oxides (NOx) in the lean exhaust gas can no longer be completely reduced with a three-way catalyst. In order to keep nitrogen oxide emissions within prescribed limits, for example the Euro-IV boundary value, nitrogen oxide storage catalysts are used additionally in conjunction with such internal combustion engines. These nitrogen oxide storage catalysts are operated such that in them the large amounts of nitrogen oxides which are produced by the internal combustion engine are stored. As the amount of stored nitrogen oxides increases, a saturation state in the nitrogen oxide storage catalyst is reached so that the nitrogen oxide storage catalyst must be discharged. To this end, for a so-called discharge phase, switching takes place briefly to substoichiometric, rich engine operation by means of the engine control or engine control device, in which the internal combustion engine is operated with a rich mixture which has a shortage of air. At the start of this discharge phase, the oxygen reservoir of the nitrogen oxide storage catalyst is generally emptied, by which the oxygen which is necessary for the discharge process is made available. In this discharge process the stored nitrogen oxide is reduced to nitrogen ($N_2$) especially by the hydrocarbons (HC) and carbon monoxide (CO) which are present in a large amounts under these rich operating conditions; this nitrogen can then be released into the environment. Operating the internal combustion engine of a motor vehicle in a first operating range as the lean operating range is already known in general; in this first operating range the internal combustion engine is operated with a lean mixture which has an air excess and thus an oxygen excess, and the nitrogen oxides produced by the internal combustion engine are stored in a nitrogen oxide storage catalyst, to discharge the nitrogen oxide storage catalyst by means of an engine control device switching from the lean operating range to the rich operating range taking place, in which the internal combustion engine is operated with a rich mixture which has a shortage of air and in which the nitrogen oxides stored in the nitrogen oxide storage catalyst during the lean operating range are discharged from the nitrogen oxide storage catalyst. Furthermore there is a second operating range as a homogeneous operating range in which the internal combustion engine is operated with an essentially stoichiometric homogeneous mixture (lambda=1), switching between the lean operating range and the homogeneous operating range being undertaken by the engine control device depending on the operation-dictated load requirement and/or rpm requirement when a definable switching condition is reached, and switching taking place by the engine control device into the rich operating range first for discharge of the nitrogen oxide storage catalyst before switching from the lean operating range to the homogeneous operating range. Specifically, the lean operating range in this instance is for example a stratified one in conjunction with a dynamic driving style, as is the case for example in city driving, switching generally takes place by the engine control device based on the lean operating range in which the lambda value is approximately 1.4, in particular based on the operation-dictated increased load requirement and/or rpm requirement, into the homogenous operating range, in which the internal combustion engine is operated essentially with a stoichiometric homogeneous mixture of lambda=1. Before switching into the homogeneous operating range, the engine control device switches first into the rich operating range in order to discharge the nitrogen oxide storage catalyst. Research has shown that in this operating mode, in spite of temporary lean operation, the theoretical lean operation fuel savings potential which is actually present is not fully exhausted. Another problem here is that in a very dynamic driving style it is necessary to depart from the lean operating range due to an increased demand for torque more often under certain circumstances, by which then each time there is a need for nitrogen oxide storage catalyst discharge, i.e., a rich operating phase. This also leads to increased fuel consumption.

Similar process guidance is known from the generic DE 100 64 279 A1, in which, depending on the deterioration of the exhaust gas composition, switching takes place between lean, rich and homogeneous operation. The switching decision is made depending on the deterioration of the storage capacity of the nitrogen oxide storage catalyst which is designated as the $NO_x$ absorption means. In particular, when a deterioration of the efficiency of the nitrogen oxide storage catalyst is ascertained, lean operation which is designated as an oxygen excess-air-fuel ratio operation is to be blocked.

DE 197 53 718 C1 discloses a process for operating a diesel engine which comprises an engine control which controls operation of the diesel engine depending on the engine characteristics and which enables rich/lean control of the diesel engine. The engine control comprises a computer which effects switching to rich or lean operation of the diesel engine depending on predetermined switching criteria. Furthermore, there are sensors which communicate with the computer and which monitor the parameters are necessary for the switching criteria, and a memory which communicates with the computer, in which the engine characteristics are stored for operation of the diesel engine. The computer effects switching from lean to rich operation when the maintenance of a regeneration temperature of the storage catalyst element through which the exhaust gases of the diesel engine have flowed and the presence of a predetermined charging state of the storage catalyst element through which the exhaust gases of the diesel engine have flowed are satisfied as the switching criteria. Furthermore, the computer effects switching back from rich to lean operation when one of the switching criteria for switching from lean to rich operation is not present or a regeneration time has elapsed which depends on the respective charging state of the storage catalyst element through which the exhaust gases of the diesel engine have flowed at the start of the rich operating phase, or there is a predetermined content of the reducing agent in the exhaust gases downstream from the storage catalyst element or the exhaust gas temperature is below a predetermined threshold value.

Furthermore, in the dissertation of Andreas Hertzberg (Stuttgart 2001) entitled "Operating strategies for a spark ignition engine with direct injection and a $NO_x$ storage catalyst" in Chapter 6, especially under item 6.4.2, tests on operation of an internal combustion engine in lean operation are described and evaluated. Here the focus was especially on the consumption difference of various test driving cycles depending on torque threshold values.

SUMMARY OF THE INVENTION

The object of the invention is therefore to make available an alternative process for operating the internal combustion engine of a vehicle, in particular a motor vehicle, with which an operating mode of the internal combustion engine which has been optimized with respect to fuel consumption, especially by optimized lean operation, becomes easily possible.

The engine control device of the invention blocks switching into the lean operating range if the additional amount of fuel consumption for discharges in a certain, definable evaluation interval which extends over several lean operating phases is greater than or equal to the reduced amount of fuel consumption by lean operation in this evaluation interval. Furthermore the engine control device enables lean operation and thus switching between the lean operating range and the homogeneous operating range if the additional amount of fuel consumption for discharges in the evaluation interval is smaller than the reduced amount of fuel consumption by lean operation in this evaluation interval. The reduced amount of fuel consumption is determined as a function of the raw mass flow value of the nitrogen oxide averaged over the evaluation interval, as a function of the amount of fuel saved which has been averaged over the evaluation time interval in the lean operating phases which occur in the evaluation interval compared to the homogeneous operating range phases, and as a function of the time between two torque requirements which exceed a definable load boundary value and/or rpm boundary value and which cause departure from the lean operating range, which time has been averaged over the evaluation interval. Furthermore, the additional amount of fuel consumption is determined as a function of a storage catalyst charging state averaged over the evaluation interval.

Advantageously, in this operation of an internal combustion engine the driving behavior of the driver can be "learned" and thus a prediction can be made with respect to probable future driving behavior. That is, in this operating mode the driving behavior in the past is evaluated over a reasonable evaluation interval and based on this evaluation a prediction for the future, i.e., for the presumed lean operating time, can be computed. In contrast to a purely steady-state approach, in this approach which is referenced to the evaluation interval on average, here if necessary the lean operating range is thus not enabled even if this would occur according to a purely steady-state standpoint at a certain time, since the driving behavior and not the current steady-state operating point is now taken into account overall as claimed in the invention over the averaged values by the approach and the focus on a reasonable time window.

Consequently, an especially optimized operating mode, especially with respect to fuel savings by lean operation, is possible overall.

As a result, the lean operation fuel savings potential is fully exhausted since switching into the lean operating range is carried out only when this is reasonable based on the driving behavior of the driver, i.e., it may entail fuel savings. As soon as the engine control device recognizes that this is not the case, the homogeneous operating range is chosen. The evaluation interval is especially advantageously at least approximately 100 seconds.

According to an especially preferred process guidance, provision is made such that the additional amount of fuel consumption which is caused by the rich operating phases in the evaluation interval is computed as the sum of a first amount of fuel which is required for discharge of the oxygen reservoir and a second amount of fuel which is required for discharge of the nitrogen oxide reservoir. The first amount of fuel, i.e., the amount of fuel for discharging the oxygen reservoir, is thus more or less constant per lean operating phase, while the second amount of fuel is mainly a function of the raw nitrogen oxide emissions during the lean time, so that the second amount of fuel is averaged over the evaluation interval, by which the additional amount of fuel consumption can be easily determined as a function of the storage catalyst charging state averaged over the evaluation interval. Since lean operation is run with an excess of oxygen, the oxygen reservoir of the nitrogen oxide storage catalyst is very quickly completely charged so that the oxygen charging of the nitrogen oxide storage catalysts over the lean phase can always be regarded as more or less constant. The nitrogen oxide charging of the nitrogen oxide storage catalyst is conversely mainly a function of the lean time and optionally also of the raw nitrogen oxide mass flow. For example, for regeneration of 1 g of oxygen an amount of fuel of approximately 0.23 g is necessary, while for regeneration of 1 g of nitrogen dioxide approximately 0.15 g of fuel are necessary.

A provision may also be made such that the first lean time is computed from the quotient of the current nitrogen oxide storage capacity of the nitrogen oxide storage catalyst and the averaged raw nitrogen oxide mass flow value. The averaged time between two torque requirements which exceed a definable load boundary value and/or rpm boundary value and which cause departure from the lean operating range as the second lean time is compared to the first lean time, the minimum or the shorter of the two lean times then being multiplied by the averaged amount of fuel saved in the evaluation interval. In this way, the reduced amount of fuel consumption in the evaluation interval can be determined especially easily. With this process guidance an especially simple and reliable prediction of the driving dynamics and thus also a conclusion about future driving behavior are possible, so that optimized operation of the internal combustion engine, especially optimization of the lean operating phases, becomes possible.

By special preference, the current nitrogen oxide storage capacity amount of the nitrogen oxide storage catalyst can be determined as a function of the temperature and/or the ageing state and/or sulfurization.

Specifically provision may be made such that the nitrogen oxide mass flow upstream from the nitrogen oxide storage catalyst and/or the nitrogen oxide mass flow downstream from the nitrogen oxide storage catalyst are each integrated over the same time interval, the switching operating point being determined as a function of the instantaneous operating temperature at the instant of switching to establish the switching instant from the storage phase to the discharge phase and thus from the lean operating range to the rich operating range at least from the integral value of the nitrogen oxide mass flow upstream and/or downstream from the storage catalyst and/or the switching instant when a definable discharge switching condition is satisfied in the first stage for determination of the degree of ageing of the storage catalyst. Then the respective switching operating point in a second stage for determining the degree of ageing of the storage catalyst is compared to the definable storage catalyst capacity field which runs over a temperature window, which is optimized especially with respect to fuel consumption, and which is formed by a plurality of individual operating points for a new and an aged storage catalyst. In the process a switching operating point which lies within the storage catalyst capacity field does not constitute a failure to reach the minimum nitrogen oxide storage capacity, but the change relative to the previous operating point as a measure of the ageing of the storage catalyst. A switching operating point which departs from the storage catalyst capacity field conversely constitutes a failure to reach the minimum nitrogen oxide storage capacity. With this procedure current detection of the value of the nitrogen oxide storage capacity of the nitrogen oxide storage catalyst can thus be determined especially easily depending on the operating point with consideration of the degree of ageing and/or sulfurization of the nitrogen oxide storage catalyst.

A provision may be made especially preferably here that to establish the switching instant from the storage phase to the discharge phase, the relative nitrogen oxide slip as the difference between the nitrogen oxide mass flow which has flowed into the nitrogen oxide storage catalyst and the nitrogen oxide mass flow which has flowed out of the nitrogen oxide storage catalyst is determined relative to the storage time, such that the quotient of the integral values of the nitrogen oxide mass flow upstream and downstream from the nitrogen oxide storage catalyst is moreover brought into a relative relationship to the definable degree of conversion of the nitrogen oxide which is derived from the exhaust gas boundary value, so that when this definable switching condition is present switching from the storage phase to the discharge phase is carried out at the switching instant which has been optimized with respect to fuel consumption and storage potential.

A provision furthermore may be made such that the storage catalyst capacity field is limited relative to the temperature window on the one hand by the boundary line for a new storage catalyst and on the other hand by the boundary line for an aged storage catalyst which represents the boundary ageing state. In this instance the temperature window comprises preferably temperature values between approximately 200° C. and approximately 450° C.

BRIEF DESCRIPTION OF THE DRAWINGS

The invention will be described in greater detail with the aid of the drawings.

DETAILED DESCRIPTION OF THE INVENTION

Figure 1:
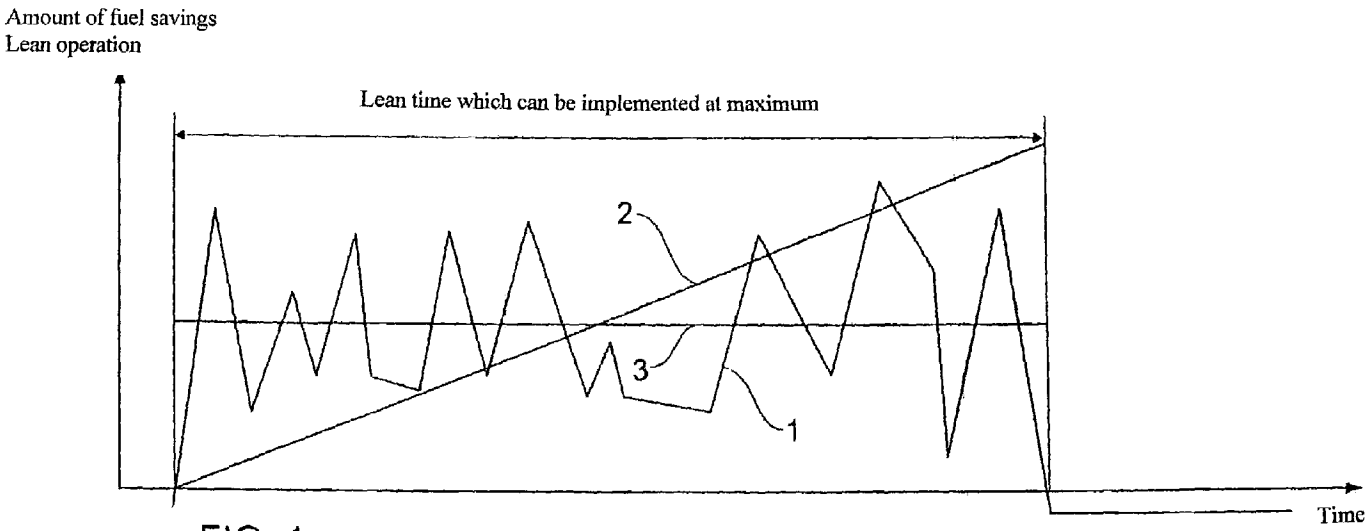
FIG. 1 shows a schematic diagram of the amount of fuel savings in lean operation over time and FIG. 2 shows a schematic diagram of the dictated relationships of the additional amount of fuel consumption over time.

FIG. 1 shows the amount of fuel savings in the lean operating range over time, curve 1 showing the time characteristic of fuel savings during the lean time which can be implemented at maximum. Curve 2 plots the integral of the amount of fuel savings during this lean time which can be implemented at maximum. Curve 3 conversely plots the averaged amount of fuel savings which is referenced to time during this lean time which can be implemented at maximum.

To determine the reduced amount of fuel consumption, this mean amount of fuel savings according to curve 3 must be multiplied by the lean time which can be implemented at maximum. To determine the lean time which can be implemented at maximum, first the averaged time between two torque requirements which exceed a definable load boundary value and/or rpm boundary value and which cause departure from the lean operating range can be determined. This averaged time is referenced to the evaluation interval, i.e., different exceeding torque requirements are compared in terms of their time interval, and thus the averaged time value is made available. This averaged time between two torque requirements which exceed a definable load boundary value and/or rpm boundary value and which cause departure from the lean operating range represents a so-called second lean time. The quotient of the current nitrogen oxide storage capacity of the nitrogen oxide storage catalyst and the averages raw mass flow value of nitrogen oxide is determined as the first lean time. The current nitrogen oxide storage capacity of the nitrogen oxide storage catalyst is thus determined as a function of the temperature and/or degree of ageing and/or sulfurization. The averaged raw mass flow value of the nitrogen oxide is determined here for the evaluation interval likewise by the engine control device. Then this first lean time is compared to the second lean time, the smaller of the two lean times, i.e., the minimum of these two mean times, is used in order to be multiplied by the averaged amount of fuel savings in the evaluation interval.

Figure 2:
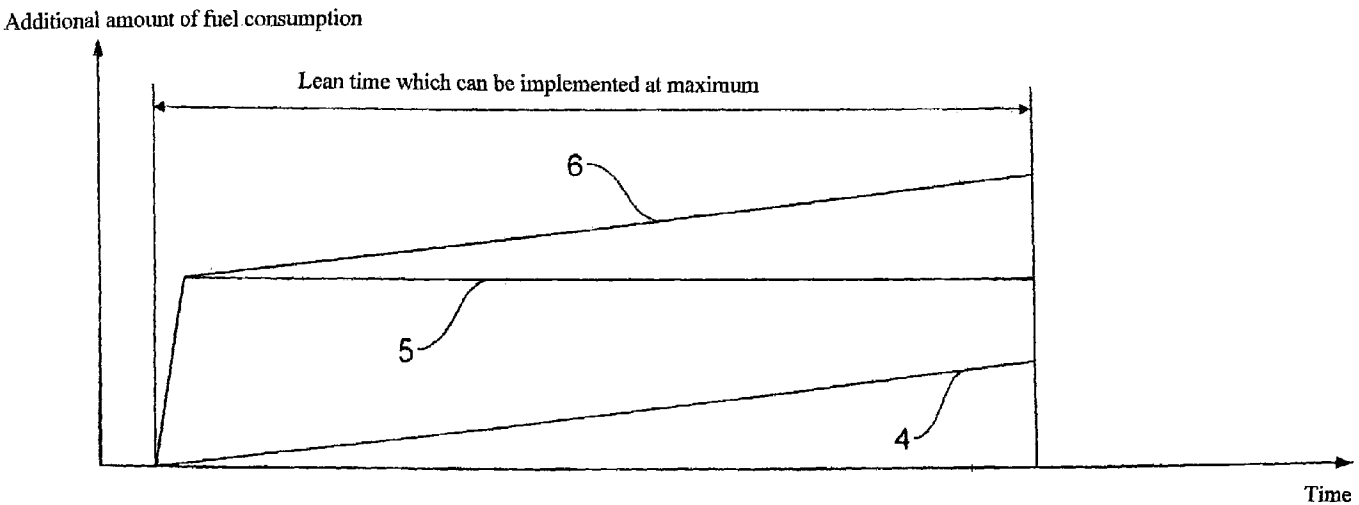

To determine the additional amount of fuel consumption the sum for the rich phases of the first amount of fuel which is required for discharge of the oxygen reservoir of the nitrogen oxide storage catalyst, which rich phases follow the lean phase, and a second amount of fuel which is required for discharge of the nitrogen oxide reservoir of the nitrogen oxide storage catalyst is found. This relationship is shown in FIG. 2. FIG. 2 shows that the amount of fuel for discharge of the oxygen reservoir is more or less constant (curve 5), while the second amount of fuel for discharge of the nitrogen oxide reservoir (curve 4) is a function of the lean time, since the oxygen reservoir is more or less completely charged immediately after the start of the lean operating phase, while the nitrogen oxides are more inert and therefore require a longer time for attachment. This means that depending on the respective lean operating phase time, more or fewer nitrogen oxides can be stored in the nitrogen oxide reservoir during this lean phase. Curve 6 is the sum of the amounts of fuel of curves 4 and 5. If averaging is also done again over time here, i.e., over the evaluation interval, time-referenced nitrogen oxide storage catalyst charging with nitrogen oxides results, so that with simultaneous consideration of the lean time the additional amount of fuel consumption can be computed using the following formula:

Additional amount of fuel consumption (*g*)=amount of oxygen stored (*g*)×first percentage amount of fuel+time-referenced, averaged $NO_x$ storage amount (*g*/*s*)×lean time (*s*)×second percentage amount of fuel.

The lean time provided here results from the sum of the individual lean operating times in the evaluation interval.

A comparison of the reduced amount of fuel consumption to the additional amount of fuel consumption, referenced to the evaluation interval, i.e., a comparison of curve 2 in FIG. 1 and curve 6 in FIG. 2, thus enables an operating mode such that the engine control device blocks switching into the lean operating range if the additional amount of fuel consumption for discharges in the evaluation interval under consideration which is preferably approximately 100 seconds is the same or greater than the reduced amount of fuel consumption by lean operation in this evaluation interval. If conversely the additional amount of fuel consumption for discharges is smaller than the reduced amount of fuel consumption by lean operation in this evaluation time interval, the engine control device enables lean operation and thus switching between the lean operating range and the homogeneous operating range.

The invention claimed is:

1. Method for operating an internal combustion engine of a vehicle comprising the steps of:

running said engine in a first operating range as the lean operating range, said running comprising operating with a lean mixture which has an air excess and thus an oxygen excess, during which nitrogen oxides produced by the internal combustion engine are stored in a nitrogen oxide storage catalyst, to discharge the nitrogen oxide storage catalyst by means of an engine control device switching from the lean operating range to the rich operating range taking place, in which the internal combustion engine is operated with a rich mixture which has a shortage of air and in which the nitrogen oxides stored in the nitrogen oxide storage catalyst during the lean operating range are discharged from the nitrogen oxide storage catalyst, and with a second operating range as a homogenous operating range in which the internal combustion engine is operated with an essentially stoichiometric homogenous mixture (lambda=1), switching between the lean operating range and the homogeneous operating range being undertaken by the engine control device depending on the operation-dictated load requirement and/or rpm requirement when a definable switching condition is reached, and switching taking place by the engine control device into the rich operating range first for discharge of the nitrogen oxide storage catalyst before switching from the lean operating range to the homogeneous operating range, and the engine control device blocking switching into the lean operating range depending on a definable blocking criterion, blocking switching with the engine control device into the lean operating range if the additional amount of fuel consumption for discharges in a certain, definable evaluation interval which extends over several lean operating phases is greater than or equal to the reduced amount of fuel consumption by lean operation in this evaluation interval, enabling lean operation by the engine control device and thus switching between the lean operating range and the homogeneous operating range, if the additional amount of fuel consumption for discharges in the evaluation interval is smaller than the reduced amount of fuel consumption by lean operation in this evaluation interval, determining the reduced amount of fuel consumption as a function of the raw mass flow value of the nitrogen oxide averaged over the evaluation interval, as a function of the amount of fuel saved which has been averaged over the evaluation time interval in the lean operating phases which occur in the evaluation interval compared to the homogeneous operating range phases in this evaluation interval, and as a function of the time between two torque requirements which exceed a definable load boundary value and/or rpm boundary value and which cause departure from the lean operating range, which time has been averaged over the evaluation interval, and determining the additional amount of fuel consumption as a function of a storage catalyst charging state averaged over the evaluation interval.

2. The process as claimed in claim 1, further comprising:

computing the additional amount of fuel consumption which is caused by the rich operating phases in the evaluation interval as the sum of a first amount of fuel which is required for discharge of the oxygen reservoir and a second amount of fuel which is required for discharge of the nitrogen oxide reservoir, wherein the first amount of fuel is more or less constant per lean operating phase, and wherein the second amount of fuel is at least a function of the raw nitrogen oxide emission during the lean time such that the second amount of fuel is averaged over the evaluation interval.

3. The process as claimed in claim 1, further comprising computing the first lean time from the quotient of the current nitrogen oxide storage capacity amount of the nitrogen oxide storage catalyst and the averaged nitrogen oxide raw mass flow value, wherein the averaged time between two torque requirements which exceed a definable load boundary value and/or rpm boundary value and which cause departure from the lean operating range as the second lean time is compared to the first lean time such that the shorter of the two lean times is then multiplied by the amount of fuel saved which has been averaged over the evaluation interval for determining the reduced amount of fuel consumption in the evaluation interval.

4. The process as claimed in claim 3, wherein the current nitrogen oxide storage capacity amount of the nitrogen oxide storage catalyst is determined as a function of the temperature and/or the ageing state and/or sulfurization.

5. The process as claimed in claim 3, wherein the currently detected value of the nitrogen oxide storage capacity of the nitrogen oxide storage catalyst is determined depending on the operating point with consideration of the degree of ageing and/or sulfurization of the nitrogen oxide storage catalyst such that the nitrogen oxide mass flow upstream from the nitrogen oxide storage catalyst and/or the nitrogen oxide mass flow downstream from the nitrogen oxide storage catalyst are each integrated over the same time interval, wherein to establish the switching instant from the storage phase to the discharge phase and thus from the lean operating range to the rich operating range at least from the integral value of the nitrogen oxide mass flow upstream and/or downstream from the storage catalyst and/or the switching instant when a definable discharge switching condition is satisfied in the first stage for determination of the degree of ageing of the storage catalyst, the switching operating point is determined as a function of the instantaneous operating temperature at the instant of switching, and wherein the respective switching operating point in a second stage for determining the degree of ageing of the storage catalyst is compared to the definable storage catalyst capacity field which runs over a temperature window, which is optimized especially with respect to fuel consumption, and which is formed by a plurality of individual operating points for a new and an aged storage catalyst such that a switching operating point which lies within the storage catalyst capacity field does not constitute a failure to reach the minimum nitrogen oxide storage capacity, but the change relative to the previous operating point as a measure of the ageing of the storage catalyst, and wherein a switching operating point which departs from the storage catalyst capacity field conversely constitutes a failure to reach the minimum nitrogen oxide storage capacity.

6. The process as claimed in claim 5, wherein to establish the switching instant from the storage phase to the discharge phase the relative nitrogen oxide slip as the difference between the nitrogen oxide mass flow which has flowed into the nitrogen oxide storage catalyst and the nitrogen oxide mass flow which has flowed out of the nitrogen oxide storage catalyst is determined relative to the storage time such that the quotient of the integral values of the nitrogen oxide mass flow upstream and downstream from the nitrogen oxide storage catalyst is moreover brought into a relative relationship to the definable degree of conversion of the nitrogen oxide which is derived from the exhaust gas boundary value so that when this defined switching condition is present, switching from the storage phase to the discharge phase is carried out at the switching instant which has been optimized with respect to fuel consumption and storage potential.

7. The process as claimed in claim 5, wherein the storage catalyst capacity field is limited relative to the temperature window on the one hand by a boundary line for a new storage catalyst and on the other hand by a boundary line for an aged storage catalyst which represents the boundary ageing state, the temperature window comprising preferably temperature values between approximately 200° C. and approximately 450° C.

8. The process as claimed in claim 1, wherein the vehicle is a motor vehicle.

9. A method for operating an internal combustion engine of a vehicle comprising:

operating said engine in a first operating range comprising:

operating said engine with a lean mixture which has an air excess and an oxygen excess;

storing nitrogen oxides produced by said engine in a nitrogen oxide storage catalyst;

switching operation of the engine to a rich operating range, wherein the rich operating range comprising utilizing a shortage of air;

discharging the nitrogen oxides from the nitrogen oxide storage catalyst; and operating said engine in a second operating range comprising:

running said engine with an essentially stoichiometric homogenous mixture (lambda=1), observing a definable switching condition depending on an operation-dictated load requirement and/or rpm requirement;

switching from the lean operating range to a rich operating range, upon reaching the definable switching condition;

blocking switching from the rich operating range to the homogeneous operating range if the additional amount of fuel consumption for discharges in a certain, definable evaluation interval which extends over several lean operating phases is greater than or equal to the reduced amount of fuel consumption by lean operation in this evaluation interval definable blocking criterion;

switching between the lean operating range and the homogeneous operating range, if the additional amount of fuel consumption for discharges in the evaluation interval is smaller than the reduced amount of fuel consumption by lean operation in this evaluation interval, determining the reduced amount of fuel consumption as a function of the raw mass flow value of the nitrogen oxide averaged over the evaluation interval, as a function of the amount of fuel saved which has been averaged over the evaluation time interval in the lean operating phases which occur in the evaluation interval compared to the homogeneous operating range phases in this evaluation interval, and as a function of the time between two torque requirements which exceed a definable load boundary value and/or rpm boundary value and which cause departure from the lean operating range, which time has been averaged over the evaluation interval, and determining the additional amount of fuel consumption as a function of a storage catalyst charging state averaged over the evaluation interval.

10. The method of claim 9, comprising using an engine control device to perform said switching during said second operating range.

11. The method of claim 9, comprising using an engine control device to perform said switching during said first operating range.

12. A method for operating an internal combustion engine of a vehicle comprising:

running said engine with an essentially stoichiometric homogenous mixture (lambda=1), observing a definable switching condition depending on an operation-dictated load requirement and/or rpm requirement;

switching from a lean operating range, having an air excess and an oxygen excess, to a rich operating range, having a shortage of air, upon reaching the definable switching condition, then to a homogenous operating range;

blocking switching from the rich operating range to the homogeneous operating range if the additional amount of fuel consumption for discharges in a certain, definable evaluation interval which extends over several lean operating phases is greater than or equal to the reduced amount of fuel consumption by lean operation in this evaluation interval definable blocking criterion;

switching between the lean operating range and the homogeneous operating range, if the additional amount of fuel consumption for discharges in the evaluation interval is smaller than the reduced amount of fuel consumption by lean operation in this evaluation interval, determining the reduced amount of fuel consumption as a function of the raw mass flow value of the nitrogen oxide averaged over the evaluation interval, as a function of the amount of fuel saved which has been averaged over the evaluation time interval in the lean operating phases which occur in the evaluation interval compared to the homogeneous operating range phases in this evaluation interval, and as a function of the time between two torque requirements which exceed a definable load boundary value and/or rpm boundary value and which cause departure from the lean operating range, which time has been averaged over the evaluation interval, and determining the additional amount of fuel consumption as a function of a storage catalyst charging state averaged over the evaluation interval.

* * * * *